United States Patent [19]

Anderson

[11] Patent Number: 4,854,734

[45] Date of Patent: Aug. 8, 1989

[54] FLEXIBLE CONTAINERS

[75] Inventor: Ian M. Anderson, Sandringham, Australia

[73] Assignee: Courtaulds Packaging Australia Limited, Victoria, Australia

[21] Appl. No.: 143,573

[22] Filed: Jan. 13, 1988

[30] Foreign Application Priority Data

Feb. 4, 1987 [AU] Australia ..... PI0181

[51] Int. Cl.[4] ..... B65D 33/16

[52] U.S. Cl. ..... 383/66; 383/96

[58] Field of Search ..... 383/43, 66, 96, 906

[56] References Cited

U.S. PATENT DOCUMENTS

| | | | |
|---|---|---|---|
| 2,413,721 | 1/1947 | Lobl | 383/66 |
| 2,499,150 | 2/1950 | Lobl | 383/66 |
| 4,257,537 | 3/1981 | Uhlig | 222/153 |
| 4,542,530 | 9/1985 | Thomas et al. | 383/66 |
| 4,618,994 | 10/1986 | Bishop | 383/96 |

FOREIGN PATENT DOCUMENTS

| | | |
|---|---|---|
| 8700146 | 1/1987 | Australia . |
| 8600239 | 3/1987 | Australia . |
| 007685 | 1/1980 | European Pat. Off. . |
| 072699 | 2/1983 | European Pat. Off. . |

*Primary Examiner*—Stephen Marcus
*Assistant Examiner*—Nova Stucker
*Attorney, Agent, or Firm*—Bell, Seltzer, Park & Gibson

[57] ABSTRACT

A container for use in aseptic packaging which contains a resilient plug to seal the container. The plug is attached to the periphery of the inlet opening by resilient straps which allow the plug to be pushed into the opening to close it and which allow the plug to be displaced to open the container by pressure of product flow into the container.

3 Claims, 1 Drawing Sheet

FLEXIBLE CONTAINERS

This invention relates to improvements in flexible containers for storing and transporting flowable products.

Flexible containers of sizes up to 200 litres are conventionally used for storage and transport of liquid food products.

European patents 007,685 and 072,699 disclose a packaging system which enables a flexible package to be filled and emptied through a single orifice which can be sealed by heat sealing flap across the opening.

Australian patent application 58187/86 and 61207/86 disclose a variation of this construction where the opening can be closed by a plug attached to the opposite wall of the package.

In both cases, the packages can be pre-sterilized and used for aseptic filling. They can be resealed at the filling station and the product can be dispensed through the same orifice.

The container disclosed in Australian patent applications 58187/86 and 61207/86 has the defect that if the flexible container is lifted by grasping the side walls, because the plug connection and the opening are attached to opposite walls, undue stress is placed on the plug seal and leakage of contents can occur which in turn can lead to spoilage of the product.

The flexible containers of European patents 007,685 and 072,699 do not suffer from this defect but they do require heat sealing equipment for sealing and a puncturing tool for dispensing.

It is an object of this invention to provide a flexible container for aseptic filling which overcomes these defects.

To this end, the present invention provides a flexible container for use in aeptic filling and storage which includes an opening in a wall thereof having connected to its periphery a plug for sealing engagement with said opening, said connection being a resilient connection arranged to enable said plug to be sealingly engaged by pushing the plug toward the opening.

The plug needs to be a tight sealing fit into the inlet/-outlet orifice. The plug can be detached by pressure from outside of the container and resealing can be achieved by applying pressure through the opposite wall of the container. Desirably the plug is secured to the periphery of the inlet/outlet opening by resilient connections which keep the plug correctly oriented to ensure that resealing achieves a tight secure seal. The plug and attachment means is preferably composed of synthetic plastic material similar in nature to the inlet/-outlet orifice in the wall of the container.

By this construction the plug is not secured to the opposite wall of the container and is not subjected to stress during handling of the container. Likewise, heat sealing of the container is avoided.

A preferred embodiment of this invention will now be described with reference to the drawings in which.

Figure 3:
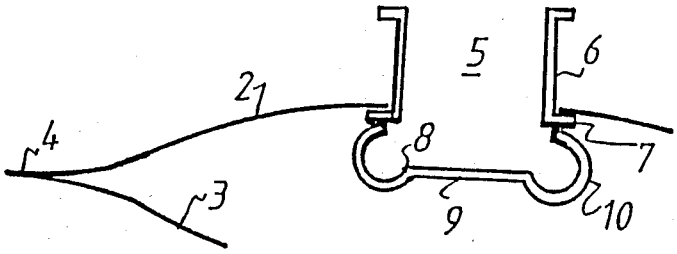

FIG. 3 schematically shows a plug removed from the orifice to allow filling or dispensing.

The container comprises two walls 2 and 3 sealed together at seam 4. The wall 2 contains the inlet/outlet orifice 5 comprising a collar 6 having flanges 7 to which the wall 2 is welded.

Attached to the flange 7 is the plug 8 which comprises the body 9 and resilient attachment portions 10.

Figure 1:
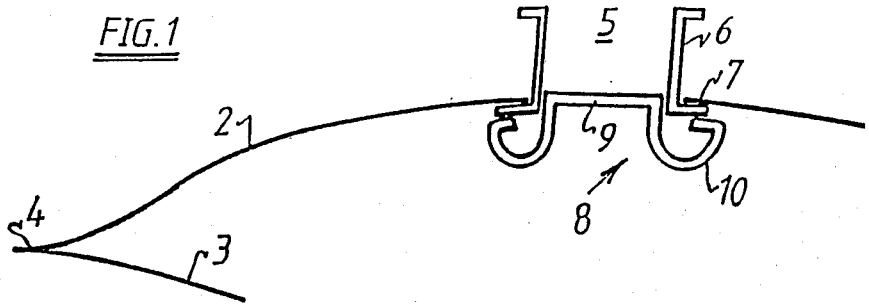
FIG. 1 is a schematic side view of the inlet/outlet of a flexible container according to this invention.
Figure 2:
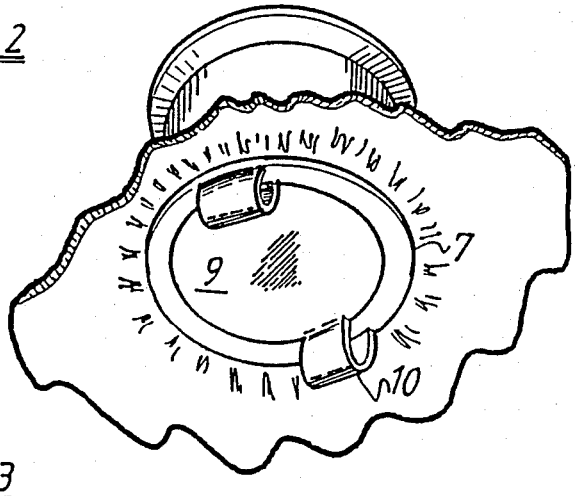
FIG. 2 is a plan view of the orifice of FIG. 1.

The body portion 9 forms a sealing fit within collar 6 as shown in FIG. 1.

The pressure of liquid product or a plunger can be ued to displace the plug 8 as shown in FIG. 3 to enable filling or dispensing. By using a plunger to contact the body 9 through wall 3 the plug 8 can be re-inserted into collar 6 to seal the opening 5.

Preferably the resilient connections 10 enable the body portion to remain aligned with the orifice 5 to ensure correct fitting of the plug 8 into the collar 6.

From the above, it can be seen that the invention provides a simple means of providing a resealable aseptic container.

I claim:

1. In a flexible container for use in aseptic filling and storage and dispensing of liquids and including flexible wall portions sealed together and an inlet/outlet orifice of predetermined configuration and dimensions in one of said wall portions and including a collar surrounding said inlet/outlet orifice and being supported in fixed relationship with said one of said wall portions; the combination therewith of plug means of similar configuration and dimensions as said orifice and disposed internally of said container for being moved into and out of sealing engagement with said collar for sealing and opening said orifice and said container for storage of liquids and for filling and dispensing of liquids, said plug means including a plurality of equally-spaced flexible connector means connecting said plug means to said collar for moving said plug means into and out of sealing engagement with said collar and for ensuring proper seating of said plug means in sealing engagement with said collar.

2. In a flexible container, as set forth in claim 1, in which said flexible connector means comprise a pair of diametrically located connector straps.

3. In a flexible container, as set forth in claim 2, in which said collar includes a flange synthetic plastic material bonded to said one of said wall portions of said container, and said plug means and said container straps comprise synthetic plastic material.

* * * * *

UNITED STATES PATENT AND TRADEMARK OFFICE

CERTIFICATE OF CORRECTION

PATENT NO. : 4,854,734

DATED : August 8, 1989

INVENTOR(S) : Ian McArthur Anderson

It is certified that error appears in the above-identified patent and that said Letters Patent is hereby corrected as shown below:

Col. 2, Claim 3, line 53, after the word "flange" insert --of--.

Col. 2, Claim 3, line 55, delete the second occurrence of "container" and insert --connector--.

Signed and Sealed this

Twenty-second Day of May, 1990

*Attest:*

*Attesting Officer*

HARRY F. MANBECK, JR.

*Commissioner of Patents and Trademarks*